US008960145B2

(12) United States Patent
Ichi

(10) Patent No.: US 8,960,145 B2
(45) Date of Patent: Feb. 24, 2015

(54) VALVE GEAR

(75) Inventor: Satoaki Ichi, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 13/997,157

(22) PCT Filed: Nov. 29, 2011

(86) PCT No.: PCT/JP2011/006623

§ 371 (c)(1),
(2), (4) Date: Jul. 17, 2013

(87) PCT Pub. No.: WO2012/086131

PCT Pub. Date: Jun. 28, 2012

(65) Prior Publication Data

US 2013/0298858 A1 Nov. 14, 2013

(30) Foreign Application Priority Data

Dec. 21, 2010 (JP) ..... 2010-284543

(51) Int. Cl.

| | |
|---|---|
| ***F01L 1/18*** | (2006.01) |
| ***F01L 1/047*** | (2006.01) |
| ***F01L 1/053*** | (2006.01) |
| ***F01L 13/00*** | (2006.01) |
| ***F01L 1/02*** | (2006.01) |

(52) U.S. Cl.

CPC ..... *F01L 1/047* (2013.01); *F01L 1/053* (2013.01); *F01L 13/0026* (2013.01); *F01L 2001/0537* (2013.01); *F01L 1/18* (2013.01); *F01L 1/022* (2013.01)

USPC ..... 123/90.44; 123/90.39

(58) Field of Classification Search

CPC ..... F01L 1/053; F01L 13/0026; F01L 1/022; F01L 1/047; F01L 1/18; F01L 2001/0537

USPC ..... 123/90.44, 90.48, 90.39

See application file for complete search history.

(56) References Cited

U.S. PATENT DOCUMENTS 4,174,683 A * 11/1979 Vivian ..... 123/48 C

FOREIGN PATENT DOCUMENTS

JP 04082342 A 3/1992
JP 06299807 A 10/1994

(Continued)

OTHER PUBLICATIONS

Japanese Patent Office, International Search Report of PCT/JP2011/006623, Jan. 24, 2012, WIPO, 4 pages.

*Primary Examiner* — Zelalem Eshete

(74) *Attorney, Agent, or Firm* — Alleman Hall McCoy Russell & Tuttle LLP

(57) ABSTRACT

A valve gear operates an intake valve for a plurality of cylinders. The valve gear includes a driving cam shaft that rotates with an engine crankshaft, a driven member operated by a driving cam of the driving cam shaft, a pivot member which pivots in association with movement of the driven member causing the intake valve to reciprocate, and a valve gear case accommodating the cam shaft, the driven member, the pivot member, and a control shaft. The valve gear case mounts to an intake-side part of a cylinder head, and includes end wall portions at both ends in a longitudinal direction, an inter-cylinder wall portion, and connection wall portions connecting the end wall portions and the inter-cylinder wall portion.

11 Claims, 10 Drawing Sheets

(56) References Cited

FOREIGN PATENT DOCUMENTS

| | | | |
|---|---|---|---|
| JP | 2003155906 | A | 5/2003 |
| JP | 2005069043 | A | 3/2005 |
| JP | 2006029246 | A | 2/2006 |
| JP | 2006105082 | A | 4/2006 |
| JP | 2008008157 | A | 1/2008 |
| JP | 2010019160 | A | 1/2010 |

* cited by examiner

VALVE GEAR

TECHNICAL FIELD

The present invention relates to a valve gear of an engine, and more particularly to the structure of a valve gear provided in a cylinder head for operating an intake valve or an exhaust valve.

BACKGROUND ART

Generally a so-called double overhead cam shaft-type (DOHC type) valve operating system which has a pair of cam shafts for operating an intake valve and an exhaust valve, individually is conventionally adopted in a high-performance engine. In this structure, intake-side and exhaust-side cam shafts are arranged side by side on a cylinder head in a manner of rotating in synchronization with rotation of a crankshaft (an output shaft of an engine), and the intake valve and exhaust valve for each cylinder are made to reciprocate by a driving cam of each cam shaft. A pivot mechanism, such as a rocker arm, may be interposed between the driving cam and the valve.

In recent years, among the pivot mechanisms, a pivot mechanism including a so-called lost motion mechanism which does not transmit a portion of operation (motion) corresponding to the contour of the driving cam has been put into practical use. This pivot mechanism can change lift characteristics of a valve using the lost motion mechanism. In the case of incorporating such a variable mechanism, the structure of the valve operating system becomes complicated, leading to an increased number of parts. Therefore, a method of unitizing the parts of the valve operating system into a unit before installing them in a cylinder head is proposed.

For example, in the cylinder head disclosed in Patent Document 1, a cylinder head assembly is configured such that a ladder-like cam shaft holder extending over the whole upper part is provided, intake-side and exhaust-side cam shafts are rotatably supported in an upper position of the cam shaft holder while intake-side and exhaust-side rocker shafts are rotatably supported in a lower position of the cam shaft holder, and rocker arms are installed to the rocker shafts. By installing this cylinder head assembly in the cylinder head, and fastening the ladder-like cam shaft holder, the rigidity of the whole cylinder head can be increased.

Similarly, even in the variable valve operating mechanism disclosed in Patent Document 2, a ladder-like frame (intermediate member) extending over the whole upper part of a cylinder head is provided, intake-side and exhaust-side component parts of the valve operating system are assembled within the frame, and then the assembled component parts are installed in a cylinder head. In this structure, a plurality of links is combined to enable continuous changes in the lift characteristics of the intake valve. Although the structure is complicated and the number of parts is large, since the parts are assembled in advance within the frame and then the assembled parts are installed in the cylinder head, the ease of work is secured.

In regard to mass production engines, generally the sizes of the component parts of the valve operating systems may vary within a tolerance range. Similarly in a cylinder head, every cylinder may vary in size and shape. Accordingly, if the number of the component parts of the valve operating system increases like the above-mentioned conventional art, those variations may be superimposed, so that an increase in variations in lift characteristics, such as a lift amount, lift timing, and the like of valves may not be avoidable.

For this reason, in the valve gears disclosed in Patent Documents 3 and 4, a mechanism that adjusts the lift amount for each valve is provided. This mechanism measures the lift amount for each valve in a state in which the valve gear is installed in the cylinder head, and adjusts the lift amount so that the variations may decrease.

PRIOR ART DOCUMENTS

Patent Documents

Patent Document 1: Japanese Laid-Open Utility Model Application Publication No. 04-82342
Patent Document 2: Japanese Laid-Open Patent Application Publication No. 2005-69043
Patent Document 3: Japanese Laid-Open Patent Application Publication No. 2006-29246
Patent Document 4: Japanese Laid-Open Patent Application Publication No. 2006-105082

SUMMARY OF THE INVENTION

Problems to be Solved by the Invention

However, since the car engines of the latter conventional arts (Patent Documents 3 and 4) include not only the variable mechanism provided in the valve operating system which has generally little margin for a layout space but also the mechanism for adjusting the lift amount, an interval between the component parts is very narrow. For this reason, in a state in which all of the component parts are assembled into the cylinder head, a tool for adjustment or the hand of a worker who holds the tool tends to interfere with the surrounding component parts and the like, and thus work is not easy.

Of course, there is also a method of disassembling the valve gear installed in the cylinder head once and selectively assembling the component parts so as to reduce the variation in the lift amount, instead of providing the mechanism for adjusting the lift amount. However, it is complicated and not likely to be practical to implement this method in a mass production line.

Under consideration of the circumstances, an object of the present invention is to provide a valve gear of an engine which can easily and accurately adjust variation in lift characteristics of intake or exhaust valves for a plurality of cylinders.

Solutions to the Problems

The present invention was made in view of the circumstances, and a valve gear according to the present invention is a valve gear that operates an intake valve or an exhaust valve of an engine provided with a plurality of cylinders, the valve gear including a cam shaft that operates in association with rotation of an output shaft of the engine, a pivot mechanism that is operated by a driving cam of the cam shaft and causes either the intake valve or the exhaust valve to reciprocate using a pivot member, and a case member which accommodates the cam shaft and the pivot mechanism in such a manner that the cam shaft and the pivot mechanism are movable.

The case member is removably installed to either an intake side or an exhaust side so as to be laid on a cylinder head from above while extending over the plurality of cylinders, and includes end wall portions disposed at both ends in a direction in which the cylinders are arranged, an inter-cylinder wall portion disposed between the adjacent cylinders, and connection wall portions configured to extend in the direction in which the cylinders are arranged and to connect the end wall portions and the inter-cylinder wall portion.

That is, according to the present invention, unlike the above-described former conventional arts (Patent Documents 1 and 2) in which the intake-side and exhaust-side component parts are collectively unitized into a unit, only either intake-side or exhaust-side valve gear is unitized as a unit and the unit is then installed in the cylinder head. For example, when the intake-side valve gear is unitized as a unit, if a variation in a lift amount or the like is adjusted before the unit is installed in the cylinder head, component parts of the exhaust-side valve operating system will not become obstructive at the time of adjustment.

Furthermore, if either the intake-side valve gear or exhaust-side valve gear is unitized as a unit, compared with a case where both of the intake-side and exhaust-side valve gears are unitized as a unit, the size and weight of the unit become half. Accordingly, work of installing the unit in the cylinder head also becomes easier. Note that, a case where either the intake-side valve gear or exhaust-side valve gear is unitized as a unit means a configuration in which both of the intake-side and exhaust-side valve gears are not unitized as a unit, the case naturally includes a case where the intake-side and exhaust-side valve gears are unitized as different units, respectively.

Here, when it is assumed that the variation in the lift amount is adjusted before a valve operating mechanism unit in which all of the intake-side and exhaust-side component parts are collectively unitized into a unit is installed in the cylinder head like Patent Documents 1 and 2 described above, if the unit is fastened to the cylinder head, the ladder-like frame is deformed due to errors in size and shape for each cylinder in the cylinder head, and a positional relationship between the component parts of the valve operating system is likely to be shifted by an extent which exceeds a tolerance range.

Conversely, according to the present invention, only either the intake-side valve gear or the exhaust-side valve gear is unitized as a unit, and the size and weight thereof are small. However, since the case member includes wall portions disposed at both ends in the direction in which the cylinders are arranged and disposed at a position between the cylinders, and the wall portions are connected by the connection wall portions, it is easy to secure the rigidity of the whole case. For this reason, a practical effect of adjusting the variation in the lift amount before installing the unitized valve gear in the cylinder head can be obtained.

Patent Documents 1 and 2 described above disclose a technology in which the valve operating mechanism is unitized as a unit and the unitized valve operating mechanism is then installed in the cylinder head, but do not disclose a technology which adjust the lift variation before installing the unit in the cylinder head. That is, according to the conventional arts, it is usual for adjustment of the lift variation to be performed after the valve gear is installed in the cylinder head regardless whether the valve gear is unitized as a unit or not.

Thus, as described above, a desirable structure in terms of securing the rigidity of the valve gear unit is that a case member includes a floor portion which connects lower ends of both of the end wall portions, inter-cylinder wall portion, and connection wall portions. That is, the case member is configured in a box shape in order to increase the rigidity. Although, in this case the floor portion needs to be provided with an opening to enable the pivot mechanism to push a tappet of a valve, the size of the opening is preferably as small as possible in terms of increasing the rigidity.

Therefore, an opening of an elliptical hole may be formed in the floor portion of the case member so as to correspond to the tappet which is inserted slightly obliquely from the underside, and cutouts may be formed in the floor portion so as to extend from the periphery of the hole in a short axis direction of the ellipse so that interference between the tappet and the pivot member may be avoided. In other words, it is preferable that the opening and cutout of a necessary minimum size are formed in the floor portion of the case member so that the interference between the tappet and the pivot member that pushes the tappet may be avoided.

However, in order to unitize the valve gear as a unit in the way described above and adjust the lift amount for each valve before installing the valve gear in the cylinder head, a state in which the pivot member corresponding to each valve is in contact with the tappet must be reproduced. For this reason, a jig insertion hole, through which a bar-like jig extending in the direction in which the cylinders are arranged passes, may be formed in each of the end wall portions and the inter-cylinder wall portion of the case member, and this jig may be brought into contact with each of the pivot members.

In this case, both the end wall portions and the inter-cylinder wall portion of the case member are configured to be divided into upper parts and lower parts, and the jig insertion holes may be formed by performing a cutting process on at least one of the divided surfaces in divided positions. This is because, in the case of making a hole in the divided surface of the case member, it is not necessary to use a drill for making a hole, so it is possible to comparatively easily process the hole with high precision. It is not necessary to process both of the divided surfaces, but it is sufficient to process only one of the divided surfaces.

As a specific configuration of the valve gear, when the pivot mechanism includes a supporting shaft that pivotably supports the pivot member, holding holes of a circular cross section which rotatably hold the supporting shaft may be formed in a halved shape in the positions where the end wall portions and the inter-cylinder wall portion of the case member are divided into the upper parts and the lower parts as described above. With this configuration, the supporting shaft and the pivot member can be easily assembled with the case member.

The valve gear may further incorporate a variable mechanism which can change the lift characteristic of a valve. For example, the pivot mechanism includes a driven member operated by a driving cam of a cam shaft. The pivot member is configured to pivot about the supporting shaft in association with operation of the driven member. The driven member is rotatably connected to the pivot member with a connection pin, and is in contact with a roller which is eccentrically provided in a portion of the supporting shaft, and is supported while resisting a force applied from the driving cam.

When the supporting shaft rotates about the axial center thereof and the position of the roller is changed, a relative positional relationship between the driven member and the pivot member which respectively pivot about the connection pin changes, and motion of the driving cam which is transmitted to the pivot member from the driven member changes. This changes the lift characteristic of the valve. In this way, the variable mechanism for the valve lift is formed.

Since the number of parts used to transmit the motion of the driving cam to the valve is large in the valve gear equipped with the variable mechanism, the lift variation easily increases. For this reason, a plurality of rollers of different sizes may be prepared beforehand, for example, and the roller may be replaced with a roller of a different size to adjust the lift variation. Since the valve gear needs to be disassembled for the replacement of the rollers, the present invention which performs adjustment work before installing the valve gear in the cylinder head has a great advantage.

Effects of the Invention

As described above, according to the valve gear of the present invention, at least one of the intake-side and exhaust-side valve gears is unitized as a unit so as to be compactly accommodated in the case member, and then this unit is removably installed in the cylinder head. Accordingly, installation of the unit to the cylinder head is facilitated and adjustment of the lift variation for each valve may be easily performed before the installation. Furthermore, it is easy to secure the rigidity of the case member of the valve gear unit, and a practical effect of adjusting the lift variation before installing the valve gear unit in the cylinder head can be obtained.

EMBODIMENTS OF THE INVENTION

Figure 1:
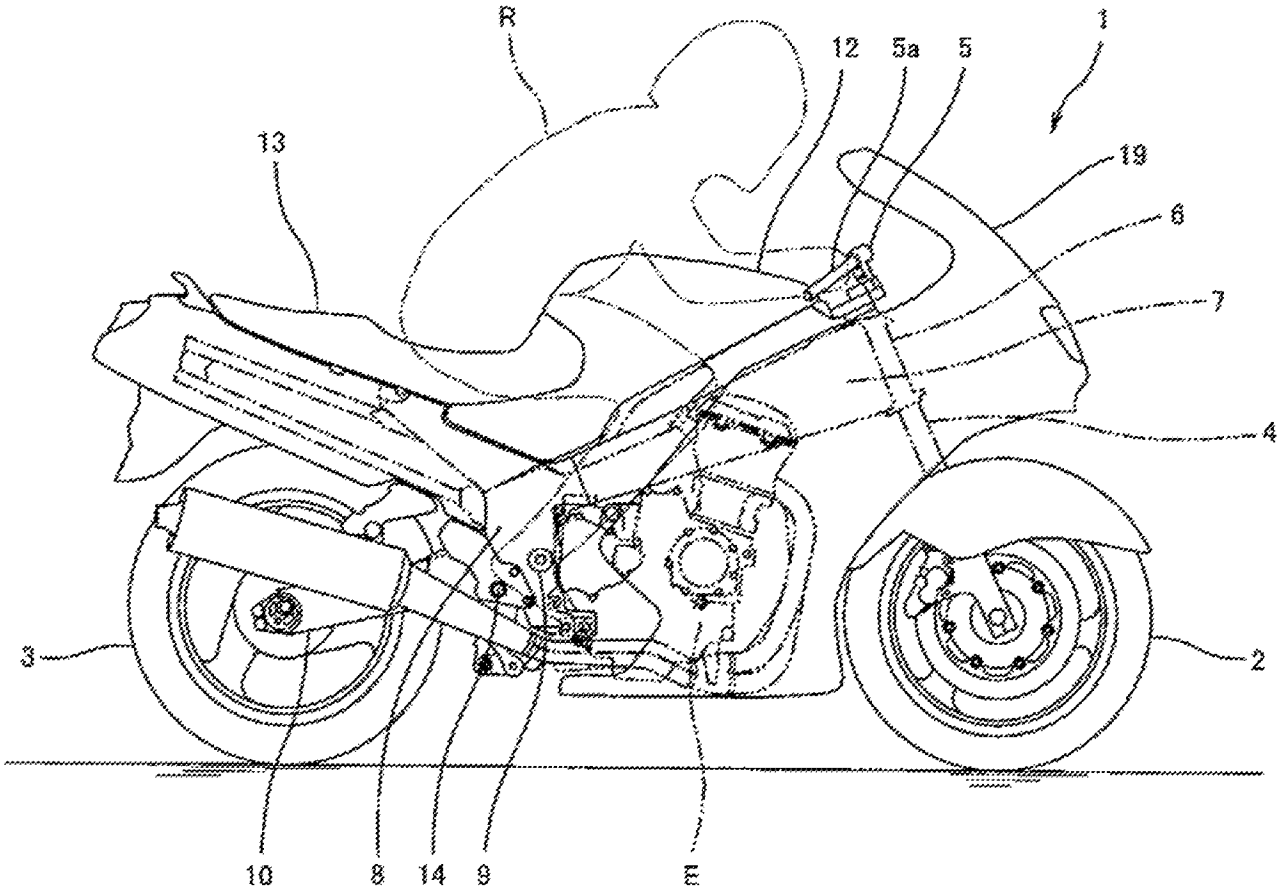
FIG. 1 is a right side view of a motorcycle to which an engine according to the present invention is mounted.

Hereinafter, an embodiment of a valve gear according to the present invention will be described with reference to the drawings. FIG. 1 is a right side view of a motorcycle 1 to which an engine E according to an embodiment of the present invention is mounted. As for directions in the following embodiments, directions are referenced from a perspective of a rider R mounting the motorcycle 1.

As illustrated in FIG. 1, the motorcycle 1 includes a front wheel 2 as a steering wheel and a rear wheel 3 as a driving wheel. The front wheel 2 is rotatably supported by lower ends of a pair of left and right front forks 4 which almost vertically extend. On the other hand, upper portions of the front forks 4 are supported by a steering shaft (not illustrated) via a pair of brackets, an upper bracket and a lower bracket. A bar-like handle 5 which extends rightward and leftward is attached to the upper bracket, and a steering shaft is supported so as to be rotatable in a state where it is inserted in a head pipe 6 of a body.

In addition, left and right ends of the handle 5 are provided with grips (a right-side is provided with an accelerator grip 5*a*), respectively. A rider R grips these grips to manipulate the handle 5. That is, the rider R can turn the front wheel 2 toward a desired direction by collectively turning the pair of front forks 4 and the front wheel 2 about the steering shaft. Furthermore, the rider R can adjust the output of the engine E by rotating the accelerator grip 5*a* gripped by the right hand by a twist of the rider's wrist.

A pair of left and right mainframes 7 which form a frame of the body extend rearward from the head pipe 6, and pivot frames 8 extend downward from rear portions of the mainframes 7, respectively. Front end portions of swing arms 10 are pivotally supported on pivots 9 provided in the pivot frames 8, respectively, and the rear wheel 3 is rotatably supported by rear end portions of the swing arms 10.

A fuel tank 12 is provided above the mainframes 7, and a rider's seat 13 is provided in the back of the mainframes 7. The engine E is mounted in a lower position of a gap between the left and right mainframes 7. The output of the engine E is transmitted to the rear wheel 3 via a drive chain (not illustrated). In the example of the figure, a cowling 19 is provided to extend over a range from the top of the front wheel 2 to the side of the engine E. The rider R drives the motorcycle while sitting on the seat 13, holding the left and right grips of the handle 5, and putting the rider's feet on steps 14 provided around the back of the engine E.

—Engine—

Figure 2:
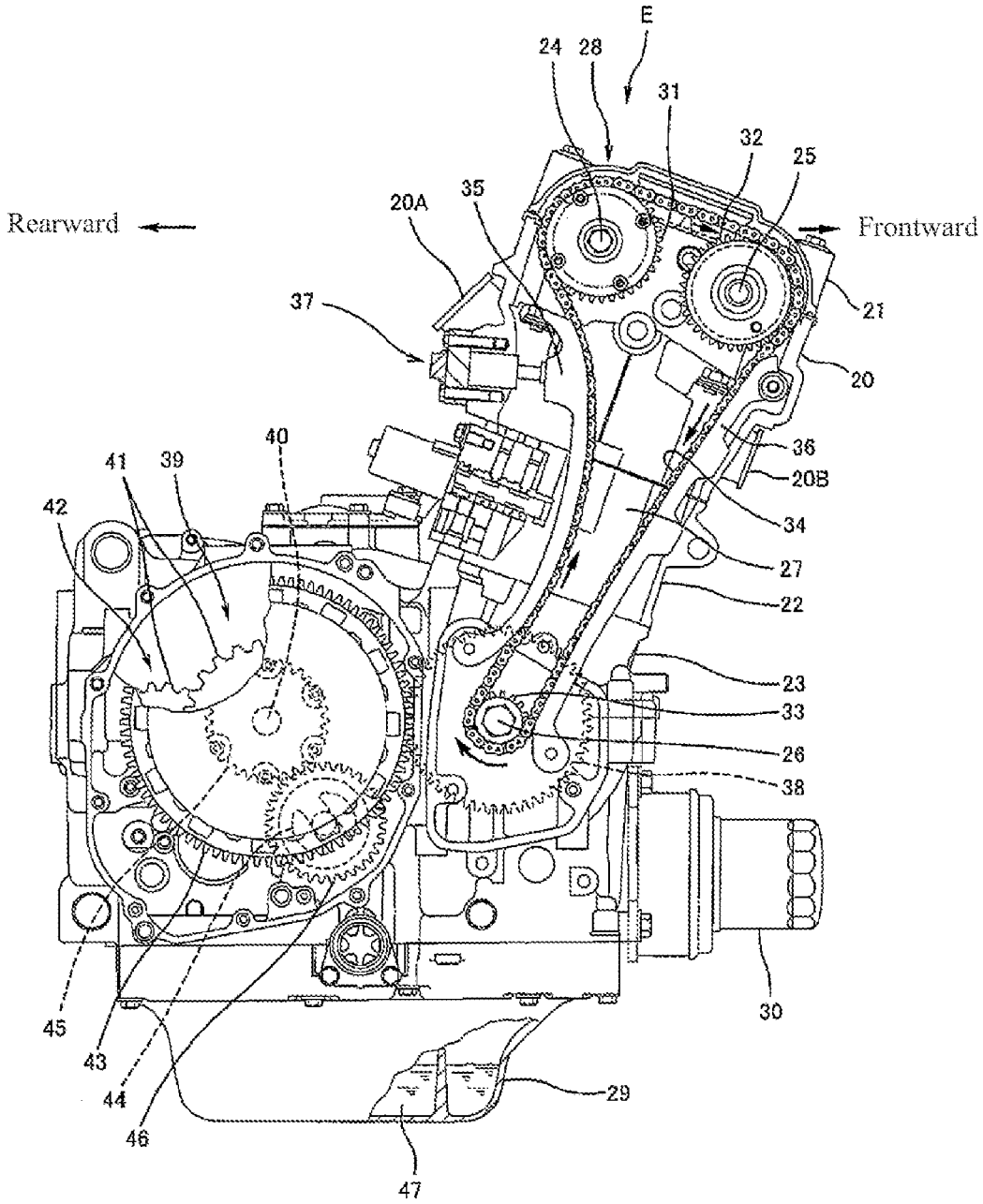
FIG. 2 is an enlarged right side view illustrating the engine, which is partially sectioned.

FIG. 2 is an enlarged right side view illustrating the engine E illustrated in FIG. 1, which is partially sectioned. For example, the engine E is a parallel 2-cylinder engine including a cylinder head 20, a cylinder head cover 21, a cylinder block 22, and a crankcase 23 as illustrated in FIG. 2. In the back of the cylinder head 20, an intake port 20A is provided for every cylinder, and is open to face in a backward and obliquely upward direction. On the other hand, in the front of the cylinder head 20, an exhaust port 20B is provided for every cylinder, and is open to face in a forward direction.

The engine E is a so-called double overhead cam shaft type (DOHC type) engine. As will be described later in detail, in an upper portion of the cylinder head 20, a driving cam shaft 24 of an intake-side valve gear 50A (see FIG. 3) and a driving cam shaft 25 of an exhaust-side valve gear 50B are arranged in a forward and rearward direction of the body, and each of the valve gears 50A and 50B extend over two cylinders in a vehicle width direction. The cylinder head cover 21 is laid to cover the top of these structures and is fixed to the cylinder head 20.

On the other hand, the cylinder block 22 is connected to a lower portion of the cylinder head 20, and two cylinders which respectively accommodate their own pistons (not shown) are formed. The crankcase 23 is connected to a lower portion of the cylinder block 22, and accommodates a crankshaft 26 extending in the vehicle width direction. A chain tunnel 27 is formed inside right wall portions of the cylinder head 20, cylinder head cover 21, cylinder block 22, and crankcase 23, and a chain-type rotation transmission mechanism 28 which transmits rotary power of the crankshaft 26 to the driving cam shafts 24 and 25 is accommodated. An oil pan 29 is installed in a lower portion of the crankcase 23, and an oil filter 30 is disposed in a front portion of the crankcase 23.

The rotation transmission mechanism 28 includes an intake cam sprocket 31, an exhaust cam sprocket 32, a crank sprocket 33, and a timing chain 34. Specifically, right end portions of the intake-side and exhaust-side driving cam shafts 24 and 25 protrude inward inside the chain tunnel 27, and the intake-side and exhaust-side cam sprockets 31 and 32 are provided in the right ends of the intake-side and exhaust-side driving cam shafts 24 and 25, respectively. Similarly, a right end portion of the crankshaft 26 also protrudes inward inside the chain tunnel 27, and the crank sprocket 33 is provided in the right end of the crankshaft 26.

In addition, the timing chain 34 is wound around the intake cam sprocket 31, the exhaust cam sprocket 32, and the crank sprocket 33. Thus, when the crank sprocket 33 rotates, the intake cam sprocket 31 and the exhaust cam sprocket 32 are driven to rotate in association with rotation of the crank sprocket 33. The diameter of the intake cam sprocket 31 and the diameter of the exhaust cam sprocket 32 are equal to each other and are two times the diameter of the crank sprocket 33. Therefore, the driving cam shafts 24 and 25 rotate once fully during a half period of the crankshaft 26.

In addition, a movable chain guide 35 and a fixed chain guide 36 are provided in the chain tunnel 27. The fixed chain guide 36 is installed to vertically extend in front of the timing chain 34, and thus extends from a position near the front of the crank sprocket 33 to a position near the bottom of the exhaust cam sprocket 32. This fixed chain guide 36 supports the front side of the timing chain 34 with a groove (not shown) which is formed in a rear portion of the fixed chain guide 36 in a longitudinal direction.

The movable chain guide 35 vertically extends in the back of the timing chain 34. A lower end portion of the movable chain guide 35 is pivotably supported on a right wall portion of the crankcase 23, in a position near the top of the crank sprocket 33, and an upper end portion of the movable chain guide 35 is located near the bottom of the intake cam sprocket 31. An upper portion of the movable chain guide 35 is biased forward by a hydraulic tensioner 37 provided in a rear wall portion of the cylinder head 20, and the movable chain guide 35 gives adequate tension to the timing chain 34 by supporting the rear side of the timing chain 34.

In addition, a driving gear 38 is provided in a right portion of the crankshaft 26, and meshes with a driven gear 43 which is provided in an input shaft 40 of a transmission 42. That is, a rear portion of the crankcase 23 is provided with a transmission chamber 39, and the input shaft 40 and the output shaft (not shown) are accommodated in the transmission chamber 39 so as to be almost in parallel with the crankshaft 26 of the transmission 42. A plurality of gears 41, which can connect to each other, are installed in both of the shafts. Thus, a speed change ratio between input and output rotations, i.e., a gear position of the transmission 42 changes with a change of the combination of the gears connected to each other.

In addition, the engine E is equipped with an oil pump 44 of a trochoid rotor type in the example of the figures. The oil pump 44 includes a pump driven gear 46 which meshes with a pump driving gear 45 provided in the input shaft 40 of the transmission 42, and the oil pump 44 is driven in association with the rotation of the crankshaft 26.

—Valve Operating System—

Figure 3:
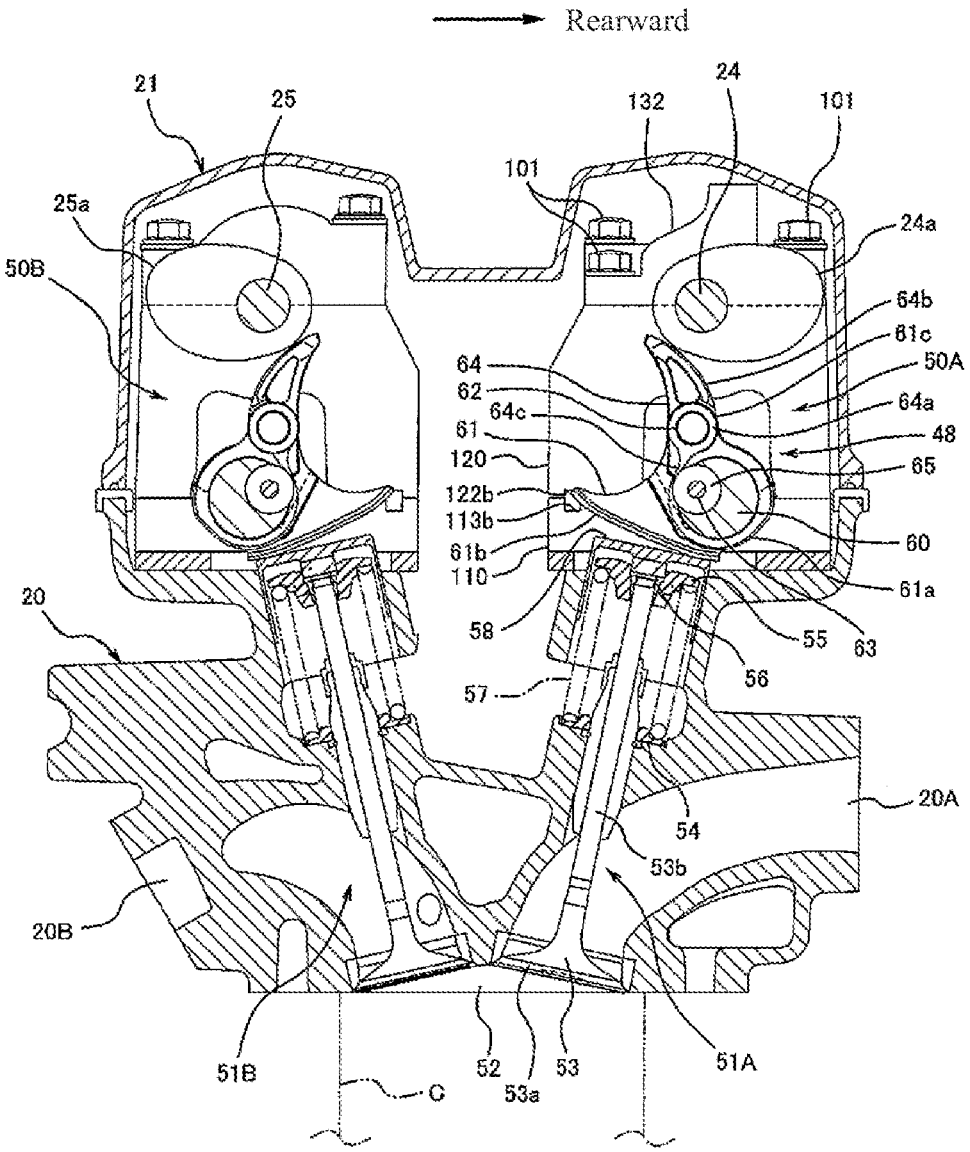
FIG. 3 is an enlarged cross-sectional view illustrating a valve operating system of the engine.
Figure 4:
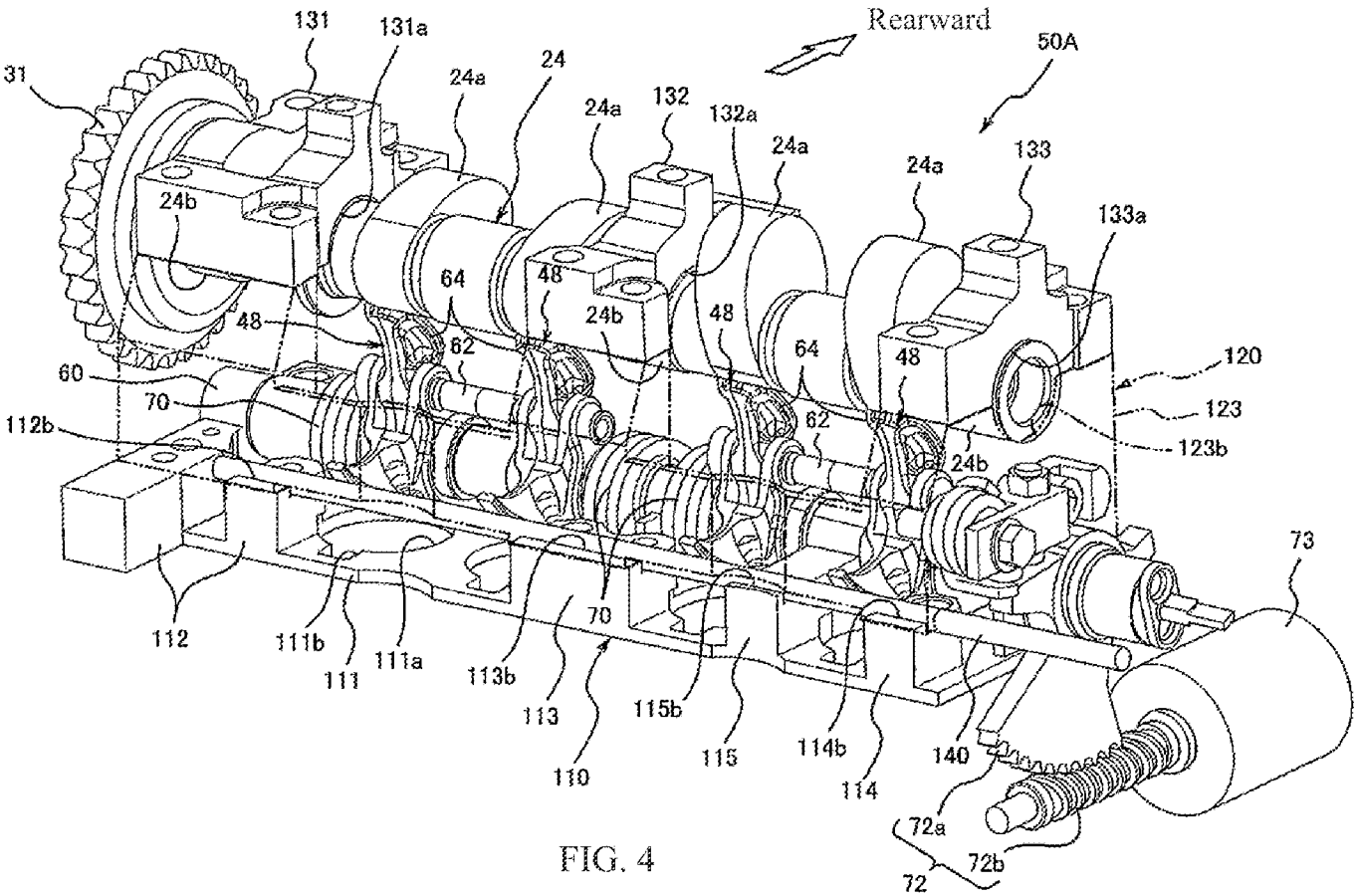
FIG. 4 is a perspective view illustrating the structure of an intake-side valve gear from which a case is partially removed.

FIG. 3 is a cross-sectional view illustrating the structure of a valve operating system of the engine E, and is opposite to FIG. 2 so that the right side in the figure indicates the rear side of the motorcycle 1. FIG. 4 is a perspective view illustrating the intake-side valve gear 50A from which the case is partially removed, and a diagonal right side in the depth direction of the paper represents the rear side of the motorcycle 1. As illustrated in FIG. 3, the cylinder head 20 includes an intake valve mechanism 51A which opens and closes the intake port 20A connected to a combustion chamber 52 which is disposed inside a cylinder C (indicating the upper side of an imaginary line), an exhaust valve mechanism 51B which similarly opens and closes the exhaust port 20B, and the intake-side and exhaust-side valve gears 50A and 50B that operate the intake and exhaust valve mechanisms 51A and 51B, respectively. Two cylinders C of the engine E are arranged in the vehicle width direction, and the combustion chamber 52 is arranged to extend along the depth direction of paper in FIG. 3 so as to correspond to the cylinders.

In this example, since the intake-side valve gear 50A and the intake valve mechanism 51A have almost identical structures to the exhaust-side valve gear 50B and the exhaust valve mechanism 51B, respectively, only the structures of the intake-side valve gear 50A and the intake valve mechanism 51A will be described as representative examples below. The intake valve mechanism 51A will be described first. A valve body 53, which has a publicly known structure and is a poppet valve, includes a flange portion 53*a* which opens and closes the intake port 20A, and a stem portion 53*b* which extends upward from the flange portion 53*a* and passes through an upper wall portion of the cylinder head 20.

An upper half portion of the stem portion 53*b* extends upward while passing through the installation hole which has a circular cross sectional shape and is formed in the upper wall portion of the cylinder head 20, along a central line of the installation hole, and an upper end portion of the stem portion 53*b* is located almost at the same height as an upper surface of the upper wall portion of the cylinder head 20. A groove is formed in the upper end portion of the stem portion 53*b*, a spring retainer 55 is installed to a cotter 56 fitted in the groove, and the spring retainer 55 is located near an upper end of the installation hole. On the other hand, a spring seat 54 is disposed in the bottom of the installation hole, and a valve spring 57 is interposed between the spring seat 54 and the spring retainer 55.

In this example, the valve spring 57 is a compression coil spring, and generates an elastic repulsive force between the spring seat 54 and the spring retainer 55. This biases the valve body 53 upward via the spring retainer 55 so that the flange portion 53*a* is pressed against the periphery (valve seat) of the opening of the intake port which faces the combustion chamber 52. That is, in the intake valve mechanism 51A, the valve body 53 is usually biased upward by the valve spring 57 and the intake port 20A stays closed.

A closed end cylindrical tappet 58 which has an opening in the bottom is installed to the stem portion 53*b* of the valve body 53 so as to cover the spring retainer 55 and upper halves of the cotter 56 and the valve spring 57. A lower bottom surface of an upper end portion of the tappet 58 is disposed to protrude from the upper end of the installation hole, and a pivot member 61 (as will be described later) of the valve gear 50A described later slidingly contacts with an upper surface of the tappet 58. When the tappet 58 is pushed downward by the pivot member 61 which is pivoted, the valve body 53 is pushed down (lifted), and the flange portion 53*a* of the valve body 53 moves away from the valve seat, thereby opening the intake port 20A.

The intake-side valve gear 50A that operates the intake valve mechanism 51A includes the driving cam shaft 24 and a pivot cam mechanism 48. The driving cam shaft 24 operates in association with the rotation of the crankshaft 26 of the engine E as described above. The pivot cam mechanism 48 converts motion corresponding to the contour of a driving cam 24*a* of the driving cam shaft 24 into pivoting motion by slidingly contacting with the driving cam 24*a* so that the pivot member 61 will push the tappet 58 of the intake valve mechanism 51A as described above.

As illustrated in FIG. 4, the driving cam shaft 24 extends in the vehicle width direction (left-right direction in the figure) to be laid over the two cylinders C (not illustrated in FIG. 4), and three journals 24*b* disposed at both ends and a center of the driving cam shaft 24 are rotatably supported on journal bearings of a valve gear case 100 which is installed to the cylinder head 20 as will be described later. For the driving cam shaft 24, two driving cams 24*a* are provided in between each two adjacent journals 24*b*, that is, a total of four driving cams 24*a* are provided, and each driving cam 24*a* operates the pivot cam mechanism 48.

That is, in the present embodiment, the intake port 20A for each cylinder C branches on the way in a manner of forming two openings communicating with the combustion chamber 52, and two sets of the intake valve mechanisms 51A are provided for every cylinder C in order to open and close each opening end. And in order to operate each set of the intake valve mechanisms 51A, two sets of the pivot cam mechanisms 48, i.e., four pivot cam mechanisms 48 are provided for every cylinder C so as to correspond the four driving cams 24*a* of the driving cam shaft 24.

—Pivot Cam Mechanism—

More specifically, the four pivot cam mechanisms 48 are supported on the supporting shaft 60 which extends in parallel with the driving cam shaft 24 and is separately disposed under the driving cam shaft 24. Since the supporting shaft 60 rotates about the axial center thereof as described below and is used to control a change in valve lift characteristics, the supporting shaft 60 is referred to as a control shaft 60 hereinafter. As illustrated in FIG. 4, four pivot members 61 are individually and pivotably supported on the control shaft 60, and the tappet 58 of the intake valve mechanism 51A (see FIG. 3) is pushed in association with the pivoting. In addition, a driven member 64 is connected to the pivot member 61 with the connection pin 62. Thus, when the driven member 64 is pushed by the driving cam 24*a*, the driven member 64 pivots about the control shaft 60 together with the pivot member 61.

Then, the tappet 58 is pushed by the pivot member 61 which pivots about the control shaft 60 together with the driven member 64, so that the valve body 53 of the intake valve mechanism 51A comes to reciprocate. That is, the motion corresponding to the contour of the driving cam 24*a* is transmitted to the intake valve mechanism 51A by the pivot member 61 and the driven member 64 which pivot about the control shaft 60 together.

Furthermore, in the present embodiment, lost motion in which a portion of the motion of the driving cam 24*a* is not transmitted to the intake valve mechanism 51A can be achieved by changing a mutual positional relationship between the pivot member 61 and the driven member 64 which pivot together as described above. That is, when the driven member 64 approaches the pivot member 61 in association with rotation of the control shaft 60 as described below, the motion transmitted to the intake valve mechanism 51A from the driving cam 24*a* decreases accordingly and as a result the lift of the valve body 53 is reduced.

More specifically, the position of the driven member 64 around the connection pin 62 with respect to the pivot member 61, i.e., a nip angle between the driven member and the pivot member continuously changes. That is, as described above, since the pivot member 61 rotates about the control shaft 60, and the rotation of the driven member 64 which rotates about the connection pin 62 of the pivot member 61 is restricted by the roller 65 embedded in the control shaft 60, if the control shaft 60 is rotated about the axial center thereof and the position of the roller 65 is changed, the mutual positional relationship between the pivot member 61 and the driven member 64 is changed.

Figure 5:
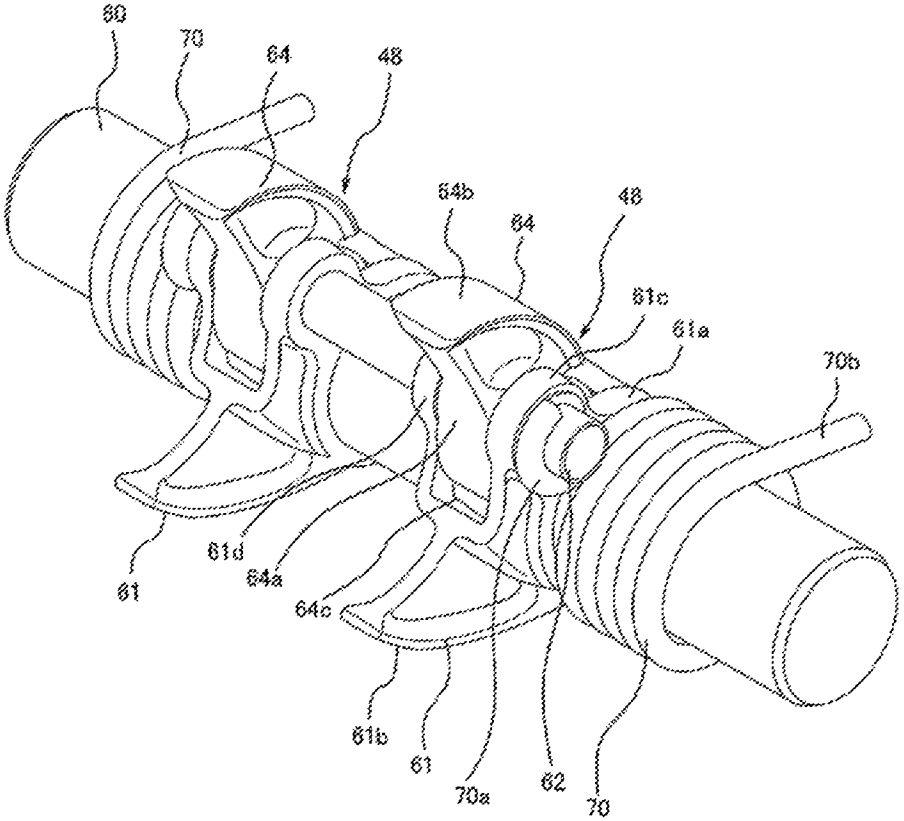
FIG. 5 is a perspective view illustrating a main portion of a pivot cam mechanism of the valve gear.
Figure 6:
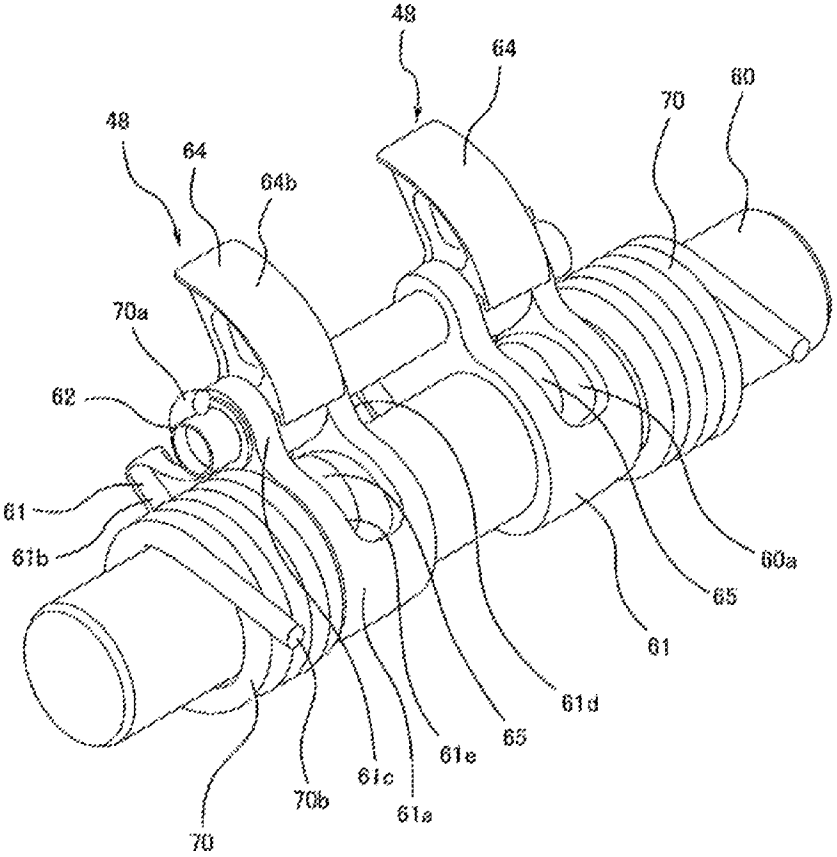
FIG. 6 is a perspective view illustrating the main portion of the pivot cam mechanism viewed from a different angle.

Hereinbelow, the configuration of the pivot cam mechanism 48 will be described in greater detail with reference to FIGS. 5 and 6. FIG. 5 is a perspective view of a main portion of the pivot cam mechanism 48 illustrated in FIGS. 3 and 4, and FIG. 6 is a perspective view illustrating the main portion of the pivot cam mechanism 48 viewed from a different angle.

First, the pivot member 61 includes a ring-shaped 61*a* rotatably and externally fitted to the control shaft 60 and a claw-shaped pivot cam portion 61*b* which protrudes outward from a lower portion of the ring-shaped 61*a* in a radial direction (sideways in FIG. 5). The pivot cam portion 61*b* pushes the tappet 58 as the pivot member 61 is pivoted as described above. The pivot cam portion 61*b* substantially looks like a fan when viewed from an axial center direction of the driving cam shaft 24 as illustrated in FIG. 3, and a lower edge of the pivot cam portion 61*b* is provided with a sliding surface which slidingly contacts with the upper surface of the tappet 58. An interval between the sliding surface and an axial center of the ring-shaped 61*a* gradually increases toward a leading end of the pivot cam portion 61*b* from a base portion of the pivot cam portion 61*b* which is disposed near the ring-shaped 61*a*.

In addition, a slot-like cutout 61*e* which elongates in a circumferential direction is formed in an upper portion of the ring-shaped 61*a* and a pair of pin supporting portions 61*c* and 61*d* protrude outward in the radial direction of the ring-shaped 61*a* from both sides of the cutout 61*e* in a manner of approaching each other as they go toward the axial center of the ring-shaped 61*a*. The connection pin 62 is inserted in through-holes of the pin supporting portions 61*c* and 61*d* so that the driven member 64 is rotatably supported.

The driven member 64 includes a ring-shaped supporting portion 64*a* in which the connection pin 62 is inserted, a claw-shaped driven portion 64*b* which protrudes outward in the radial direction (almost upward direction in FIG. 5) from an upper portion of the supporting portion 64*a*, and a lever portion 64*c* which protrudes outward in the radial direction, oppositely, from a lower portion of the supporting portion 64*a*. While the upper surface (sliding surface) of the driven portion 64*b* slidingly contacts with an outer circumferential surface of the driving cam 24*a*, the lever portion 64*c* is arranged to be loosely-fitted in a cut space of the cutout 61*e* of the pivot member 61, and is in contact with the roller 65 embedded in the control shaft 60.

That is, although not illustrated in the figure, four cavities 60*a* are respectively formed at four places in the control shaft 60 so as to correspond to the positions in which the four pivot members 61 are disposed, and the roller 65 is accommodated such that the lever portion 64*c* of the driven member 64 comes into contact with the inside surfaces of the cavities 60*a*. As illustrated in FIG. 3, the roller 65 is disposed to be shifted from the axial center of the control shaft 60 and eccentrically disposed in the vicinity of the driven member 64, and the roller 65 is rotatably supported by a bar member 63 which passes through the inside of the control shaft 60 in the axial center direction. The roller 65 comes into contact with the lever portion 64*c* of the driven member 64 as described above, and restricts motion of the driven member 64 which rotates about the connection pin 62.

That is, the driven member 64 is supported by the pivot member 61 so as to be rotatable about the connection pin 62, is in contact with the roller 65 eccentrically embedded in the control shaft 60, and is supported while resisting a force applied from the driving cam 24*a*. For this reason, if the driven member 64 is pushed to move away from the driving cam 24*a*, the driven member 64 and the pivot member 61 pivot about the control shaft 60 together.

A twist coil spring 70 is externally fitted in the control shaft 60. While an end 70*a* of the twist coil spring 70 is wound around the connection pin 62, the other end 70*b* extends toward the opposite side of the end 70*a* and is pinched and held between a floor member 110 of the valve gear case 100 described below and a body member 120. The twist coil spring 70 biases the pivot member 61 via the connection pin 62 so that the pivot member 61 may be rotated about the control shaft 60 toward the driving cam shaft 24, thereby pressing the sliding surface of the driven member 64 against the outer circumferential surface of the driving cam 24*a*.

In this configuration, if the position of the roller 65 is changed in association with the rotation of the control shaft 60 and the contact position of the roller 65 which comes into contact with the lever portion 64*c* of the driven member 64 is changed, the position of the roller 65, in the vicinity of the control shaft 60, which restricts the rotation of the driven member 64 is also changed. On the other hand, the pivot member 61 is not associated with the rotation of the control shaft 60 so that the position thereof is not changed. For this reason, a nip angle between the pivot member 61 and the driven member 64 is changed.

—Operation of Valve Gear—

An electric motor 73 is connected to the control shaft 60 via a worm gear mechanism 72 as illustrated in FIG. 4 in order to change the relative positional relationship between the pivot member 61 and the driven member 64 in the pivot cam mechanism 48 by rotating the control shaft 60 as described above. That is, as illustrated in the right end in FIG. 4, a fan-shaped worm wheel 72*a* having gear teeth on the outer circumferential surface thereof is installed to the control shaft 60 so that the worm wheel 72*a* may be rotated about the axial center of the control shaft 60, and the worm wheel 72*a* meshes with a worm gear 72*b* rotated by the electric motor 73.

And when the electric motor 73 operates and the worm gear 72*b* is rotated in response to an instruction from a controller which is not illustrated, the control shaft 60 is rotated via the worm wheel 72*a*. As described above, this operation changes the relative positional relationship between the pivot member 61 and the driven member 64 in the pivot cam mechanism 48, thereby changing a pivot range of the pivot member 61 depending on the operation of the driving cam 24*a*. In this way, the lift timing and lift amount of the valve body 53 in the intake valve mechanism 51A are changed.

Figure 7:
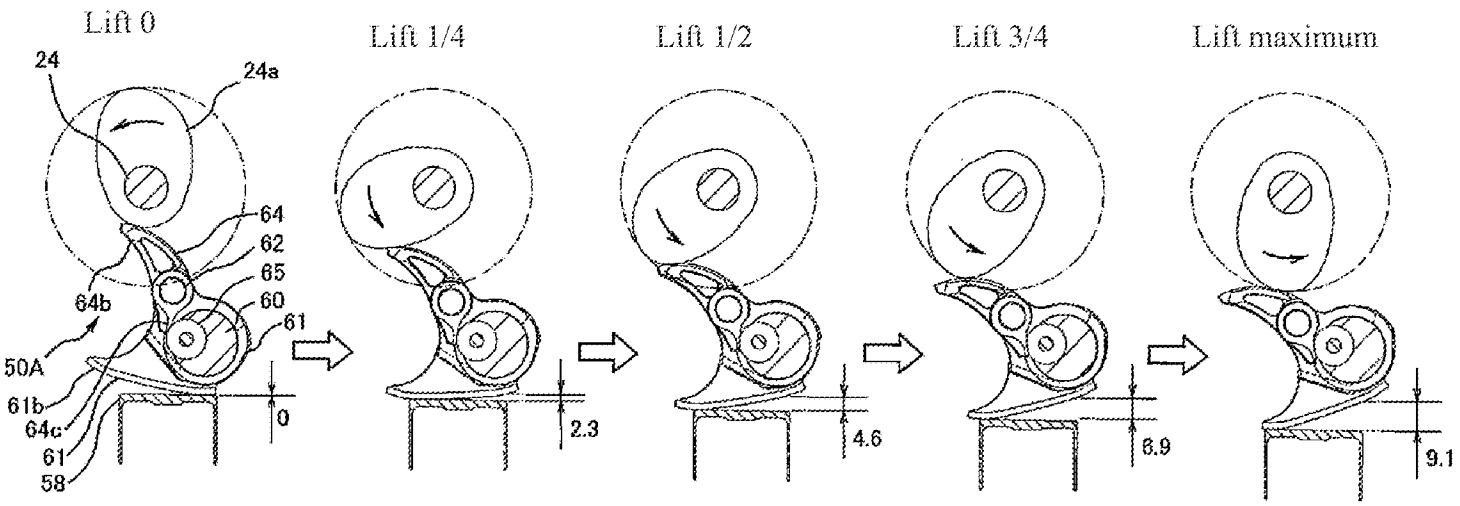
FIG. 7 is a diagram describing operation of the valve gear illustrated in FIG. 3 when in a normal condition.

As an example, operation when the valve gear 50A illustrated in FIG. 3 is in a normal condition is illustrated in FIG. 7. As illustrated in a left end in FIG. 7, at a time point of lift amount zero (lift 0) during which the driven member 64 is in contact with a base circular portion of the driving cam 24*a*, the sliding surface of the base portion in the pivot cam portion 61*b* of the pivot member 61 slidingly contacts with the upper surface of the tappet 58, and thus does not push down the upper surface of the tappet 58. As disposed in the order toward the right side in the figure, as the driving cam 24*a* rotates in a counterclockwise direction in the figure, the driven member 64 is pushed down by the driving cam 24*a*.

Since the driven member 64 is connected to the pivot member 61 via the connection pin 62 and the lever portion 64*c* thereof is in contact with the roller 65 and supported resisting the force applied from the driving cam 24*a*, the rotation of the driven member 64, which rotates about the connection pin 62, in a manner of approaching the pivot member 61 is restricted. Therefore, while the lever portion 64*c* of the driven member 64 is sliding around the roller 65, the ring-shaped 61*a* of the pivot member 61 slides on the outer circumference of the control shaft 60. Accordingly, both of them rotate about the control shaft 60 together in the counterclockwise direction in the figure. The tappet 58 is pushed down by the pivot cam portion 61*b* of the pivot member 61 and, although not illustrated in the figure, the valve body 53 advances (lifts) in a downward direction, thereby opening the intake port 20A.

Figure 8:
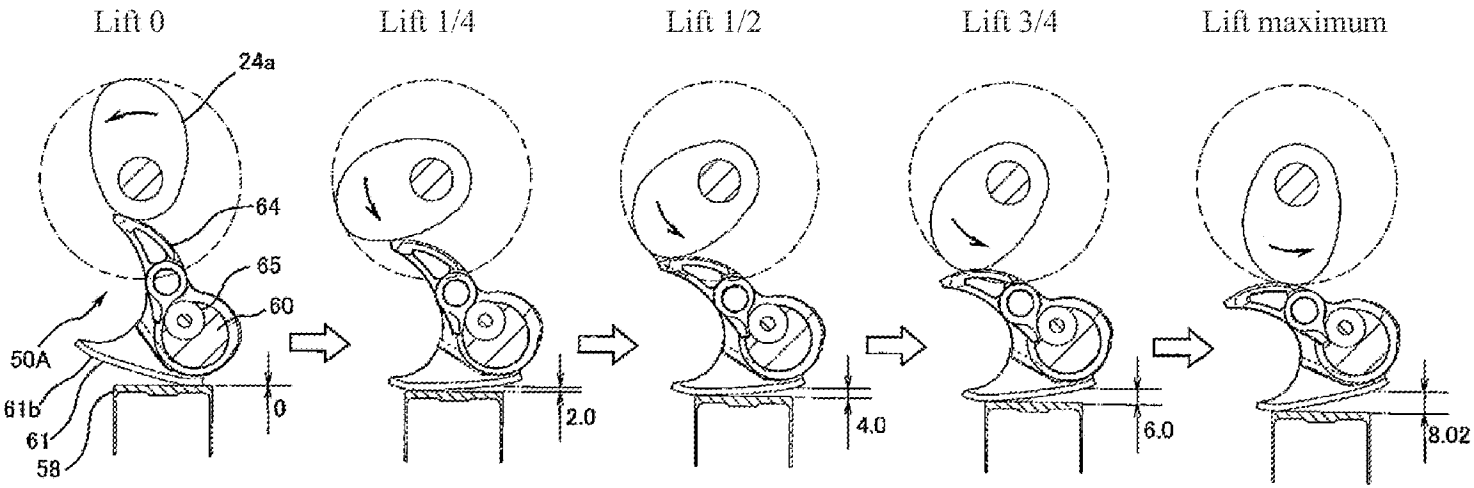
FIG. 8 is a diagram corresponding to FIG. 7 at the time of a slightly low lift.

Next, operation of the valve gear 50A which has changed to have a slightly low lift characteristic compared with the example of FIG. 7 is illustrated in FIG. 8. When the control shaft 60 rotates in a clockwise direction in FIG. 8, the roller 65 relatively moves up in relation to the rotation motion, and the contact position of the lever portion 64*c* of the driven member 64 with respect to the roller 65 changes. In the example of the figure, since the driven member 64 approaches the pivot member 61 in association with such an operation, a portion of the motion is not transmitted from the driving cam 24*a* and hence the amount of movement of the tappet 58 which is pushed by the pivot member 61 is reduced. Therefore, a valve lift becomes relatively lower at the time of the lift maximum as shown in the right end of FIG. 8.

—Structure of Unit of Valve Gear—

As described above, since the valve gear 50A which can change valve lift characteristics has a more complicated structure and includes an increased number of component parts, if the individual component parts are assembled in an engine mass production line, the working efficiency is not good. Therefore, according to the present embodiment, the intake-side valve gear 50A and the exhaust-side valve gear 50B are unitized as different units, respectively, and then installed in the cylinder head 20 in a state in which the component parts are assembled within case members.

Figure 9:
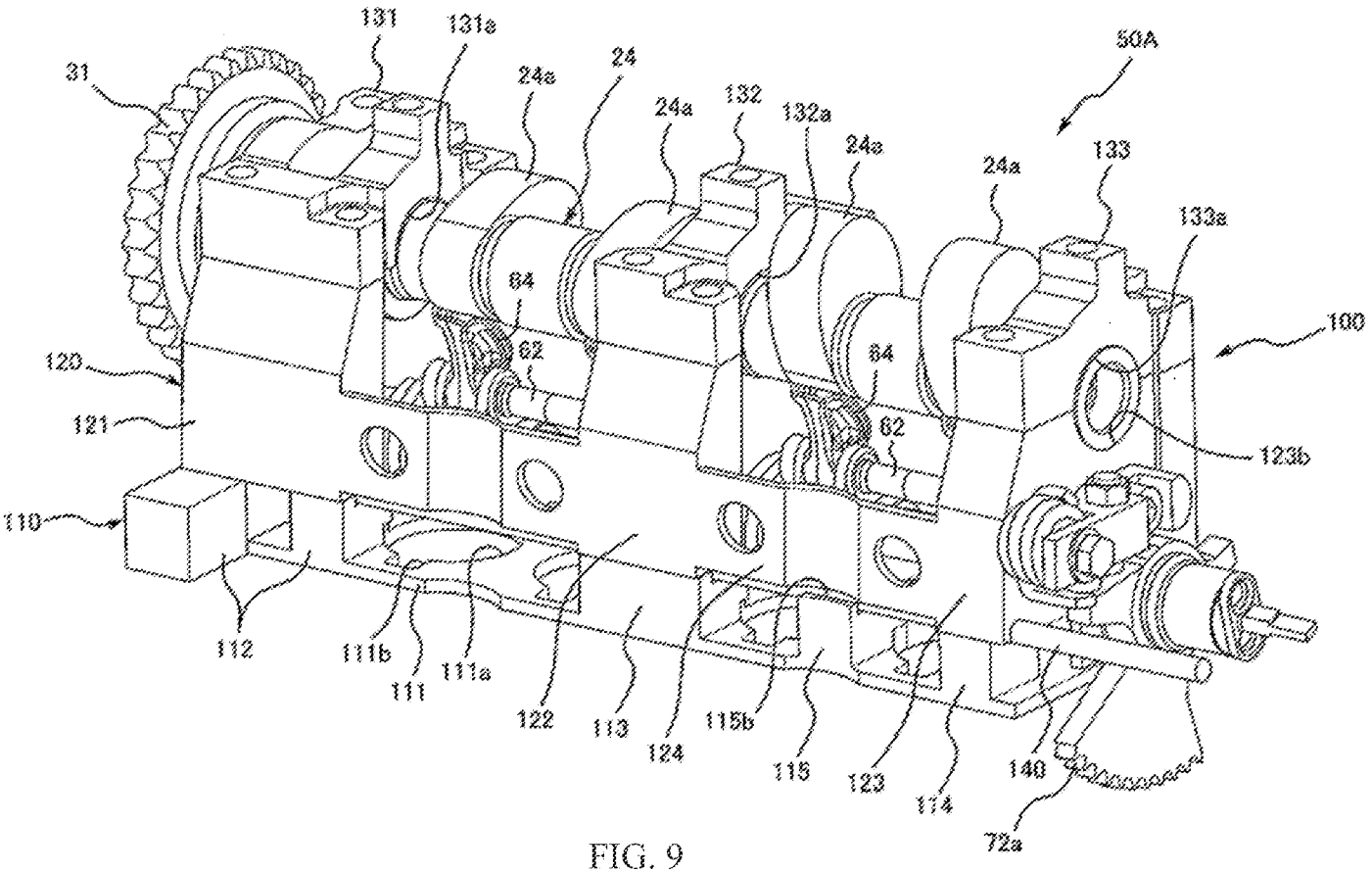
FIG. 9 is a diagram corresponding to FIG. 4 and illustrating the intake-side valve gear unit from which the case is not removed.

FIG. 9 illustrates the intake-side valve gear 50A from which the case is not removed unlike FIG. 4. As illustrated in FIGS. 4 and 9, according to the present embodiment, besides the driving cam shaft 24 and the control shaft 60, the respective pivot members 61 for the four pivot cam mechanisms 48, the connection pin 62, the driven member 64, the roller 65, the twist coil spring 70, and the like are assembled within the valve gear case 100 and unitized into a unit. This valve gear case 100 is disposed over the two cylinders C so as to cover all of the intake-side component parts within the upper wall portion of the cylinder head 20. Accordingly, it includes a case floor member 110 which is laid on an upper surface of the upper wall portion of the cylinder head 20, and a case body member 120 which is combined to be laid on top of the case floor member 110.

Figure 10C:
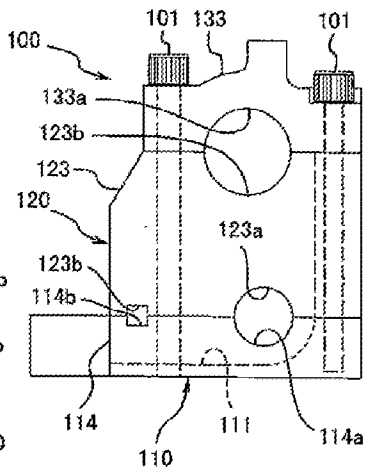
FIG. 10(*a*)-10(*c*) is a three-view drawing illustrating only a case member of a valve gear unit.
Figure 10A:
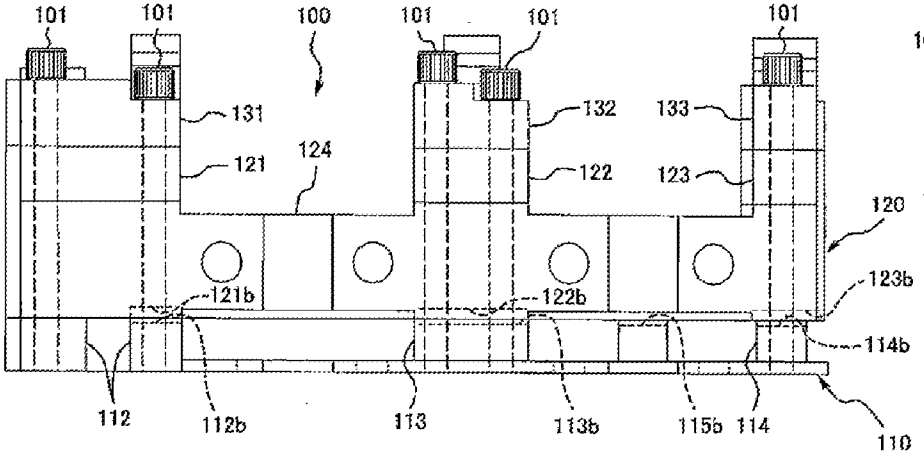
Figure 10B:
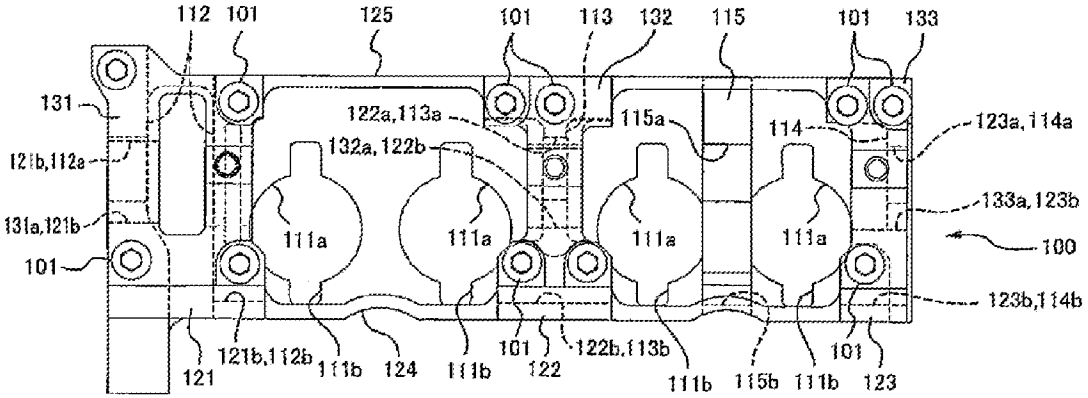

As also illustrated in FIGS. 10(*a*)-10(*c*), the case floor member 110 includes an approximately rectangular plate-like floor portion 111 and first to third pedestal portions 112 to 114 which stand in the longitudinal direction, that is, at both ends and a substantial center of the floor portion 111, respectively, in the direction in which the two cylinders are arranged. The floor portion 111 has an elliptical hole 111*a* through which the tappet 50 is inserted from the underside and cutouts 111*b* which extend from the periphery of the hole 111*a* in the short axis directions of the ellipse, that is, which extends sideways in the width direction of the floor portion 111. The cutouts 111*b* are provided to prevent interference between the floor portion 111 and the pivot cam portion 61*b* of the pivot member 61 which pivots as described above so as to press the tappet 58.

The first to third pedestal portions 112 to 114 are arranged in this order from the right end of the driving cam shaft 24 to which the intake cam sprocket 31 is fastened toward the left side (but in the order from the left end toward the right side in FIGS. 4 and 9). The first pedestal portion 112 at the left end in FIG. 9 may be divided into two halves in a thickness direction so as to correspond to an oil trap (not illustrated) which is open in the upper wall portion of the cylinder head 20. An inside portion of the first pedestal portion 112 disposed inside the case has a cavity, in the bottom, so as to accommodate the twist coil spring 70 of the pivot cam mechanism 48 therein. Similarly, the third pedestal portion 114 at the opposite end (the right end in the figure) has a cavity, which is open in the inner side, to accommodate the twist coil spring 70 therein.

The second pedestal portion 113 disposed between the first and third pedestal portions has cavities in both sides of the case floor member 110 in the longitudinal direction so that the second pedestal portion has a body having a thinner middle than edges.

The first to third pedestal portions 112 to 114 have recesses 112*a* to 114*a* of a semicircular cross-sectional shape, respectively, which are formed to support the underside of the control shaft 60. And, as described below, first to third partition wall portions 121 to 123 of the case body member 120 are placed from above to be combined with upper ends of the first to third pedestal portions, holding holes of a circular cross-sectional shape are formed between them, and the control shaft 60 is inserted and rotatably held between the upper part and the lower part. In addition, according to the present embodiment, a pedestal portion 115 having a recess 115*a* is also formed between the second and third pedestal portions 113 and 114.

The first to third partition wall portions 121 to 123 are provided at both ends and a center of the case body member 120, in the longitudinal direction, which is combined with the case floor member 110 so as to correspond to the first to third pedestal portions 112 to 114, respectively. In addition, the case body member 120 includes side wall portions 124 and 125 (connection wall portions) which extend over the whole length thereof at both ends in the terms of the width direction, and the side wall portions 124 and 125 connect the three partition wall portions 121 to 123. The first to third partition wall portions 121 to 123 of the case body member 120 are combined with the first to third pedestal portions 112 to 114 of the case floor member 110, respectively so that the end wall portions disposed at both ends in the longitudinal direction and the inter-cylinder wall portion of the valve gear case 100 will be formed.

In regard to the third partition wall portion 123 and the third pedestal portion 114, as illustrated in FIG. 10(*c*), the recesses 121*a* to 123*a* of a semicircular shape which hold the control shaft 60 from the upper side are formed in the partition wall portions 121 to 123, respectively, and the recesses 121*a* to 123*a* form the holding holes of a circular cross-sectional shape which rotatably hold the control shaft 60 cooperatively with the recesses 112*a* to 114*a* of the pedestal portions 112 to 114. In other words, the end wall portions and the inter-cylinder wall portion of the valve gear case 100 are divided into upper parts and lower parts, i.e., the pedestal portions of the case floor member 110 and the partition wall portions of the case body member 120, and each of the holding holes for holding the control shaft 60 is formed in a halved shape in the divided position.

On the other hand, first to third cam caps 131 to 133 are combined from above with upper ends of the first to third partition wall portions 121 to 123, and the driving cam shaft 24 is rotatably supported between the cam caps and the partition wall portions. Although the third partition wall portion 123 and the third cam cap 133 are illustrated in FIGS. 9 and 10, semicircular lower bearing portions 121*b* to 123*b*, which are open in upper sides thereof, are formed in upper ends of the partition wall portions 121 to 123, respectively, and the lower bearing portions 121*b* to 123*b* combine with upper bearing portions 131*a* to 133*a* of the cam caps 131 to 133, thereby forming holes of a circular cross-sectional shape, respectively, which is almost the same as that of the journal 24*b* of the driving cam shaft 24.

In the case floor member 110 and the case body member 120 which are assembled together as described above, the first to third pedestal portions 112 to 114 and the first to third partition wall portions 121 to 123 are fastened together with the first to third cam caps 131 to 133 with a plurality of bolts 101 which are illustrated only in FIGS. 10(*a*)-10(*c*). A portion of each of those bolts 101 is passed through the case floor member 110 and screwed into a bolt hole (not illustrated) of the cylinder head 20, and the bolts 101 are used to assemble the valve gear case 100.

Since the valve gear case 100 of the present embodiment has a rectangular parallelepiped box shape overall which elongates in the direction in which the cylinders C are arranged and has a comparatively high rigidity, even though it is fastened to the cylinder 20 with the bolts 101 as described above, a big distortion does not easily occur. That is, in the valve gear case 100, the end wall portions are formed in both ends in the longitudinal direction, respectively by the first and third pedestal portions 112 and 114 and the partition wall portions 121 and 123, the inter-cylinder wall portion is formed between the two cylinders C by the second pedestal portion 113 and the second partition wall portion 122, and both end wall portions and the inter-cylinder wall portion are connected by the side wall portions 124 and 125 disposed at both ends in the width direction of the valve gear case 100 and by the floor portion 111. In this manner, the valve gear case 100 forms a box shape.

In addition, although the cutout 111*b* for preventing interference between the pivot member 61 and the hole 111*a* into which the tappet 50 is inserted is formed in the floor portion 111 of the valve gear case 100, only a so-called opening or cutout of a necessary minimal size that allows motion of the intake valve mechanism 51A is formed. Therefore, it is easy to increase the rigidity and it is advantageous in terms of securing the rigidity of the valve gear case 100 and furthermore in terms of securing the rigidity of the unit (hereinafter, also referred to as valve gear unit 50A) in which the valve gear 50A is accommodated.

Among the side wall portions 124 and 125 which connect the first to third partition wall portions 121 to 123, an arc-shaped shallow hollow for preventing interference with an accommodation hole of a spark plug (not illustrated) is formed in the side wall portion 124 disposed in an inside position (see FIG. 3) in the width direction of the cylinder head 20 illustrated at the front side in FIG. 9. A round bar-like jig 140 is illustrated to be disposed in the vicinity of the lower portion of the side wall portion 124 in FIG. 9. However, since it is used at the time of adjusting a lift variation of the intake valve as described below, it is removed after finishing the adjustment.

—Adjustment of Lift Variation—

The purpose of increasing the rigidity of the valve gear case 100 and moreover, increasing the rigidity of the valve gear unit 50A as described above is to adjust such that the lift variation of the valve body 53 is reduced by equalizing the amount of movement of the tappet 58 of the intake valve mechanism 51A which is pushed by each of the pivot members 61 of the four pivot cam mechanisms 48 before installing the unitized valve gear 50A to the cylinder head 20 of the engine E.

That is, in mass production engines, generally the sizes of the component parts of the valve operating system vary within a range of tolerance. Accordingly, for the cylinder head, there are also variations in size and shape for every cylinder. Especially in the valve gear 50A incorporating the pivot cam mechanism described in the present embodiment, since motion of the driving cam 24*a* is transmitted to the tappet 58 via the driven member 64 and the pivot member 61, and dimension errors and assembly errors of the component parts including the connection pins 62 between the pivot members 61 and the driven members 64 are superimposed, there is a tendency that the variations in lift amount, lift timing, and the like for every valve increase.

From this point of view, according to the present embodiment, in the pivot cam mechanism 48, a plurality of rollers of different outer diameters is prepared beforehand so as to be used as the roller 65 which supports the driven member 64 such that the driven member 64 may be disposed around the control shaft 60, and the roller is replaced with a roller of a different size so that the lift variations may be adjusted. That is, in the valve gear unit 50A which has not yet been installed in the cylinder head 20 as illustrated in FIGS. 4 and 9, the round bar-like jig 140 is installed in a manner that the four pivot cam mechanisms 48 extend in the arrangement direction, i.e., the direction in which the two cylinders are arranged, that is, in a manner that the driving cam shaft 24 and the control shaft 60 become parallel with each other, and the state in which the pivot member 61 of each of the four pivot cam mechanisms 48 is in contact with the tappet 58 is reproduced. In this state, the lift variation is adjusted.

Therefore, the jig insertion holes are formed in the end wall portions at both ends in the longitudinal direction of the valve gear case 100 and the inter-cylinder wall portion, respectively, and the jig 140 which is inserted in the jig insertion holes is made to be in contact with the pivot member 61 of each of the four pivot cam mechanisms 48. Specifically, the jig insertion hole is formed in a joined portion of the case floor member 110 and the case body member 120, and as illustrated in FIG. 4, grooves 112*b* to 115*b* of a rectangular cross-sectional shape, which are open in the upper side, are formed in the upper surfaces of the first to fourth pedestal portions 112 to 115 of the case floor member 110 so as to be arranged in the longitudinal direction of the case floor member 110, thereby holding the round bar-like jig 140.

Similarly, in the lower surfaces of the first to third partition wall portions 121 to 123 of the case body member 120, grooves 121*b* to 123*b*, which has the substantially same shape as the grooves formed in the upper surfaces and which are open in the underside, are formed so as to face the first to third grooves 112*b* to 114*b* formed in the first to third pedestal portions 112 to 114. And in regard to the third pedestal portion 114 and the third partition wall portion 123, as illustrated in FIG. 10(*c*), the grooves 112*b* to 114*b* and the grooves 121*b* to 123*b* which face each other, respectively, are combined with each other to form the jig insertion holes of an approximately square cross-sectional shape. The width and height of a cross section of the jig insertion hole is almost the same as the diameter of a circular cross section of the jig 140, so that the jig insertion holes correctly position the jig 140 inserted thereinto.

The upper and lower grooves 121*b* to 123*b* and 112*b* to 114*b* which form the jig insertion holes can be easily formed with high precision at the time of carrying out grinding processing on each of the lower surfaces of the partition wall portions 121 to 123 of the case body member 120 and each of the upper surfaces of the pedestal portions 112 to 115 of the case floor member 110 so that the lower and upper surfaces may have required flatness, by having the upper and lower surfaces held in the same processing apparatus and then performing cutting processing. That is, the jig insertion holes of the present embodiment are formed by performing cutting processing on the divided surfaces which are to be joined with each other in positions where the end wall portions and the inter-cylinder wall portion of the valve gear case 100 are divided into upper parts and lower parts.

And when adjusting a variation in the valve lift of the valve gear unit 50A, after the valve gear 50A except for the twist coil spring 70 is assembled, the jig 140 is first inserted in the jig insertion hole between the third pedestal portion 114 and the third partition wall portion 123 and disposed so as to extend in the longitudinal direction of the valve gear case 100, and is then brought into contact with each of the pivot members 61 of the four pivot cam mechanisms 48 as illustrated in FIG. 4. In this state, the control shaft 60 is rotated so that any one of the driven members 64 among the four pivot cam mechanisms 48 may come in contact with the base circular portion of the driving cam 24*a*.

If any one driven member 64 comes into contact with the driving cam 24*a*, gaps between the three remaining driven members 64 and driving cams 24*a* are measured, and the roller 65 is replaced according to this measuring result. For example, a roller 65 with a large diameter is chosen for a pivot cam mechanism 48 with a large gap, or a roller 65 with a small diameter is chosen for a pivot cam mechanism 48 in which the driven member 64 comes into contact with the driving cam 24*a* first. The jig 140 is removed, the valve gear 50A is then disassembled to replace the installed roller with the chosen roller 65 having a different diameter, and finally valve gear 50A including the twist coil spring 70 is assembled again.

In this way, when the valve gear 50A in which the lift variation of the four pivot cam mechanisms 48 is adjusted to fall within a tolerance range is fastened to the cylinder head 20 using the bolts 101, mainly owing to errors in the size and shape of the cylinder head 20, the valve gear case 100 bends slightly in the longitudinal direction, for example, or is distorted around the shaft extending in the longitudinal direction. However, in this embodiment, as described above, since the rigidity of the box-like valve gear case 100 is high, and the deformation, such as the bending and distortion, of the valve gear unit 50A is very small, the change in the lift variation attributable to the deformation is very little.

As described above, the valve gears 50A and 50B according to the embodiment are separately unitized as different units for the intake side and the exhaust side of the engine E, respectively, accommodated in the valve gear case 100 where it is comparatively compact and highly rigid, and removably installed to the cylinder head 20. Therefore, not only the installation work becomes easy, but also the lift variation for each valve can be easily adjusted before the installation. Furthermore, deformation of the valve gear case 100 which is caused when the valve gears are fastened to the cylinder head 20 is suppressed, and the practical effect of adjusting the lift variation before the installation may be obtained as described above.

In addition, the valve gear case 100 includes the case floor member 110, the case body member 120, and the cam caps 131 to 133; the journal bearings which support the driving cam shaft 24 are provided between the cam caps 131 to 133 and the partition wall portions 121 to 123 of the case body member 120; and the holding holes for holding the control shaft 60 of the pivot cam mechanism 48 are provided between the partition wall portions 121 to 123 and the pedestal portions 112 to 114 of the case floor member 110. Accordingly, the assembling of the driving cam axis 24 and control shaft 60 can be easily performed.

Since the jig insertion holes for the jig 140 are provided between the pedestal portions 112 to 114 of the case floor member 110 and the partition wall portions 121 to 123 of the case body member 120 in the same manner as the holding holes for holding the control shaft 60, the jig holes which require highly precise positioning can be comparatively easily formed.

Other Embodiments

Description of the above embodiment is only for purpose of illustration and not for purpose of restricting applications and uses thereof. In regard to the valve gear according to the present invention, alterations, additions, or deletions may be made to the configuration of embodiments without departing from the spirit of the present invention.

For example, according to the above-described embodiment, each of the intake-side and exhaust-side valve gears 50A and 50B of the engine E includes the pivot cam mechanism 48 which can change lift characteristics, and is unitized as a unit. However, for example, only the intake-side valve gear 50A may include the variable mechanism and be unitized as a unit. In addition, the phase of a valve may also be changed for the exhaust-side valve gear 50B.

Although the valve gear case 100 in the embodiment is structured to be divided into the case floor member 110 and the case body member 120 and to further include the cam caps 131 to 133, but not limited thereto.

In addition, according to the embodiment, in order to provide the jig insertion holes in the valve gear case 100, the grooves 112*b* to 114*b* which are open are formed in the upper surfaces of the first to third pedestal portions 112 to 114 of the case floor member 110, respectively, and the grooves 121*b* to 123*b* which are open are formed in the lower surfaces of the first to third partition wall portions 121 to 123 of the case body member 120, respectively so as to face the grooves 112*b* to 114, respectively. However, the grooves may be formed only in either the upper surfaces or the lower surfaces. In this case, processing cost may be reduced.

Although, the valve gears 50A and 50B of a variable valve-timing type provided in the engine E of the motorcycle 1 are described as an example in the above-described embodiment, the valve gear according to the present invention can also be applied to a valve gear of other than a variable valve-timing type, and can also be applied to an engine of a vehicle other than a motorcycle.

INDUSTRIAL APPLICABILITY

As described above, the valve gear according to the present invention has the effect of facilitating installation to the cylinder head and of facilitating adjustment of valve lift variation, and is advantageous because it can also be applied widely to the variable valve timing type in which the effect is especially considerable.

DESCRIPTION OF REFERENCE CHARACTERS

E: Engine
C: Cylinder
24, 25: Driving cam shaft (cam shaft)
24*a*: Driving cam
26: Crankshaft (output shaft of engine)
48: Pivot cam mechanism (pivot mechanism)
50A, 50B: Valve gear
51A: Intake valve mechanism
51B: Exhaust valve mechanism
53: Valve body (intake valve)
60: Control shaft (supporting shaft)
61: Pivot member
62: Connection pin
64: Driven member
65: Roller
100: Valve gear case (case member)
110: Case floor member
111: Floor
111*a*: Insertion hole of tappet 50
111*b*: Cutout
112, 114: First, third pedestal portion (end wall portion)
112*a*, 114*a*: Recess (holding hole)
112*b*, 114*b*: Groove (jig insertion hole)
113: Second pedestal portion (inter-cylinder wall portion)
113*a*: Recess (holding hole)
113*b*: Groove (jig insertion hole)
120: Case body member
121, 123: First, third partition wall portion (end wall portion)
121*a*, 123*a*: Recess (holding hole)
121*b*, 123*b*: Groove (jig insertion hole)
122: Second pedestal portion (inter-cylinder wall portion)
122*a*: Recess (holding hole)
123*b*: Groove (jig insertion hole)
124, 125: Connection wall portion
140: Bar-like jig

The invention claimed is:

1. A valve gear that operates an intake valve or an exhaust valve of an engine provided with a plurality of cylinders, the valve gear comprising:

a cam shaft that operates in association with rotation of an output shaft of the engine;

a pivot mechanism that is operated by a driving cam of the cam shaft and causes either the intake valve or the exhaust valve to reciprocate using a pivot member; and a case member that accommodates the cam shaft and the pivot mechanism in such a manner that the cam shaft and the pivot mechanism are movable before the engine is installed to a cylinder head, the cam shaft, the pivot mechanism and the case member being unitized into a unit, wherein the case member is removably installed to either an intake side or an exhaust side so as to be laid on the cylinder head from above while extending over the plurality of cylinders, and includes end wall portions disposed at both ends in a direction in which the cylinders are arranged, an inter-cylinder wall portion disposed between adjacent cylinders, connection wall portions configured to extend in the direction in which the cylinders are arranged and to connect the end wall portions and the inter-cylinder wall portion, and a floor portion that connects lower ends of the end wall portions, the inter-cylinder wall portion, and the connection wall portions, the case member forming a box shape.

2. The valve gear according to claim 1, wherein the floor portion of the case member includes an elliptical hole, into which a tappet is inserted from underside, and a cutout configured to extend from a periphery of the hole in a short axis direction of the elliptical hole and to prevent interference with a pivot member which pushes the tappet.

3. The valve gear according to claim 1, wherein the case member accommodates the pivot mechanism and the cam shaft in a state in which a rotatable axis of the pivot mechanism is positioned below a rotatable axis of the cam shaft, and wherein the relative position of the rotatable axis of the pivot mechanism is fixed relative to the rotatable axis of the cam shaft.

4. The valve gear according to claim 1, wherein the cam shaft includes an intake-side cam shaft and an exhaust-side cam shaft; and wherein the case member accommodates one of the intake-side cam shaft and the exhaust-side cam shaft.

5. The valve gear according to claim 1, wherein the case member includes an intake-side case member and an exhaust-side case member.

6. The valve gear according to claim 1, wherein the pivot mechanism includes an intake-side pivot mechanism and an exhaust-side pivot mechanism.

7. A valve gear that operates an intake valve or an exhaust valve of an engine provided with a plurality of cylinders, the valve gear comprising:

a cam shaft that operates in association with rotation of an output shaft of the engine;

a pivot mechanism that is operated by a driving cam of the cam shaft and causes either the intake valve or the exhaust valve to reciprocate using a pivot member; and a case member that accommodates the cam shaft and the pivot mechanism in such a manner that the cam shaft and the pivot mechanism are movable, wherein the case member is removably installed to either an intake side or an exhaust side so as to be laid on a cylinder head from above while extending over the plurality of cylinders, and includes end wall portions disposed at both ends in a direction in which the cylinders are arranged, an inter-cylinder wall portion disposed between adjacent cylinders, and connection wall portions configured to extend in the direction in which the cylinders are arranged and to connect the end wall portions and the inter-cylinder wall portion, and wherein a jig insertion hole is formed in each of the end wall portions and the inter-cylinder wall portion of the case member so that a bar-like jig extending in the direction in which the cylinders are arranged is inserted through the jig insertion hole and the jig is in contact with each of the pivot members.

8. The valve gear according to claim 7, wherein the end wall portions and the inter-cylinder wall portion of the case member are configured to be divided into upper parts and lower parts, and the jig insertion holes are formed by performing cutting processing on at least one of the divided surfaces in divided positions.

9. The valve gear according to claim 8, wherein the pivot mechanism includes a supporting shaft that pivotably supports the pivot member, and holding holes of a circular cross-sectional shape which rotatably holds the supporting shaft are formed in a halved shape in the divided positions of the end wall portions and inter-cylinder wall portion of the case member.

10. The valve gear according to claim 9, wherein the pivot mechanism includes a driven member operated by a driving cam of the cam shaft, and the pivot member is configured to pivot about the supporting shaft in association with operation of the driven member, the driven member is rotatably connected to the pivot member with a connection pin, is in contact with a roller which is eccentrically provided in a portion of the supporting shaft, and is supported while resisting a force applied from the driving cam, and when the supporting shaft rotates about an axial center thereof and the position of the roller is changed, a relative positional relationship between the driven member and the pivot member which respectively rotate about the connection pin changes.

11. A valve gear that operates an intake valve or an exhaust valve of an engine provided with a plurality of cylinders, the valve gear comprising:

a cam shaft that operates in association with rotation of an output shaft of the engine;

a pivot mechanism that is operated by a driving cam of the cam shaft and causes either the intake valve or the exhaust valve to reciprocate using a pivot member; and a case member that accommodates the cam shaft and the pivot mechanism in at least one of an intake side and an exhaust side in such a manner that the cam shaft and the pivot mechanism are movable before the engine is installed to a cylinder head, the cam shaft, the pivot mechanism and the case member being unitized into a unit, wherein the case member is removably installed to either the intake side or the exhaust side so as to be laid on the cylinder head from above while extending over the plurality of cylinders, and includes end wall portions disposed at both ends in a direction in which the cylinders are arranged, an inter-cylinder wall portion disposed between adjacent cylinders, connection wall portions configured to extend in the direction in which the cylinders are arranged and to connect the end wall portions and the inter-cylinder wall portion, and a floor portion that connects lower ends of the end wall portions, the inter-cylinder wall portion, and the connection wall portions, the case member forming a box shape.

* * * * *